US007209701B1

(12) United States Patent
Kopecky

(10) Patent No.: US 7,209,701 B1
(45) Date of Patent: Apr. 24, 2007

(54) CLEANING BLADE SYSTEM FOR ELECTROPHOTOGRAPHY

(76) Inventor: Eugene Francis Kopecky, Jomtien Plaza Condo #1802, 406 Moo 12 Jomtien Beach Road, Pattaya (TH) 20260

( * ) Notice: Subject to any disclaimer, the term of this patent is extended or adjusted under 35 U.S.C. 154(b) by 0 days.

(21) Appl. No.: 10/965,460

(22) Filed: Oct. 13, 2004

Related U.S. Application Data

(60) Division of application No. 10/202,426, filed on Jul. 22, 2002, now Pat. No. 6,813,466, which is a continuation-in-part of application No. 09/609,748, filed on Jul. 3, 2000, now abandoned.

(51) Int. Cl.
*G03G 21/00* (2006.01)

(52) U.S. Cl. ..... 399/351; 399/123

(58) Field of Classification Search ..... 399/349–351, 399/123; 15/209.1, 236.07, 256.5, 245.1, 15/245, 143.1, 145
See application file for complete search history.

(56) References Cited

U.S. PATENT DOCUMENTS 6,505,020 B1 * 1/2003 Higeta et al.

* cited by examiner

*Primary Examiner*—Susan Lee
(74) *Attorney, Agent, or Firm*—Thomas J. Tighe, Esq.

(57) ABSTRACT

A cleaning blade system for a variety of electrophotographic apparatuses. A preferably reversible, elongated, elastic wiper blade is longitudinally supported by a relatively rigid, elongated holder. The wiper holder is universally adaptable to a variety of differently configured cleaning blade mounts by a plurality of mounting adapters which all have a uniform interface with the wiper holders so that all wipers and wiper holders can be uniform. Each mounting adapter has a second interface for fastening it to at least one of the varied cleaning blade mounts in the same way that a conventional cleaning blade is fastened. The holder and mounting adapters include provisions for locating and stabilizing the disposition of wipers relative to the drums. Preferably the holder includes an interlock securing a wiper blade without adhesives. The wiper blade may include flared edges to enhance contact pressure against the drum and extend its useful life.

20 Claims, 3 Drawing Sheets

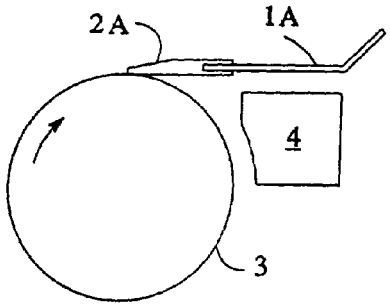
FIG. 1
PRIOR ART
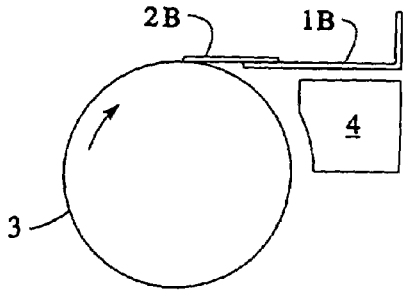
FIG. 2
PRIOR ART
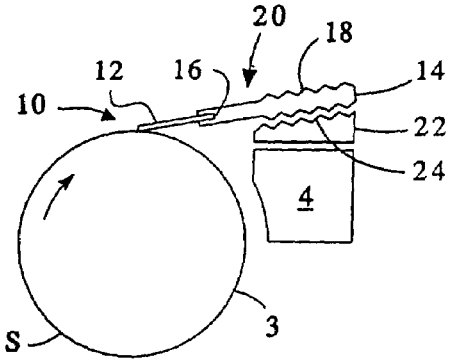
FIG. 3
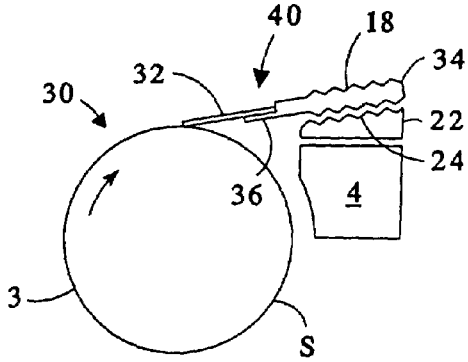
FIG. 4
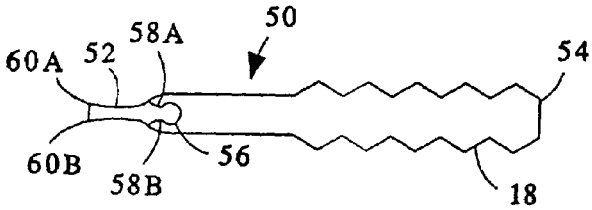
FIG. 5
FIG. 6
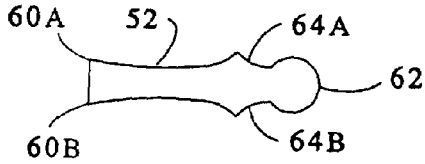

CLEANING BLADE SYSTEM FOR ELECTROPHOTOGRAPHY

This is a divisional application of U.S. patent application Ser. No. 10/202,426, filed Jul. 22, 2002, now U.S. Pat. No. 6,813,466 B1 which is a continuation in part of my abandoned patent application Ser. No. 09/609,748 filed Jul. 3, 2000.

BACKGROUND OF THE INVENTION

This invention relates to removing toner and other residue from the photosensitive drum in an electrophotographic apparatus by means of a cleaning blade consisting of a rigid holder coupled with an elastic wiper. The edge of the elastic wiper is caused to bear against the surface of the photosensitive drum, thus wiping toner and other residue off the drum as it rotates.

Two popular types of cleaning blades are distinguished by the method of forming and attaching an elastic wiper, usually polyurethane, to a rigid holder typically made of stamped steel sheet or extruded aluminum. The first type of cleaning blade is molded whereby liquid polyurethane is introduced into a mold with the rigid holder affixed therein. The assembly is oven cured to obtain the desired physical characteristics of the urethane, which is then precision trimmed to form the surface to be placed in contact with the rotating drum. The second type of cleaning blade is fabricated by attaching a polyurethane strip cut from a preformed sheet to the rigid holder using an adhesive, preferably double-sided adhesive tape.

In the family of electrophotographic apparatus, which includes copy machinery and laser printers, the diversity of geometries have spawned the development of approximately four hundred and fifty different cleaning blade configurations. The design of these systems has typically not considered the use of standardized cleaning blade configurations in different applications, leading to this proliferation of cleaning blade configurations.

In the prior art, the cleaning blades are specifically designed for a particular application without regard to using a standardized cleaning blade configuration interchangeably in different electrophotographic machines. Currently, there are no means available to locate and secure a standard configuration cleaning blade to preserve its geometric relationship with the photosensitive drum for different machines, nor to allow for interchangeability of a standard cleaning blade in different machines.

In the prior art, the cleaning blade is attached directly to a mounting area integral to the particular electrophotographic apparatus, normally using screws to secure the cleaning blade in position. Note that hereafter in this specification this mounting area described will be referred to as a "primary mounting" or alternatively as a "cleaning blade mount." The primary mounting often has ears, tabs, or other locating provisions, which cooperate with notches on one or both ends of a blade holder to locate the cleaning blade with respect to the photosensitive drum. Thus, for each apparatus, a uniform pressure, contact area, and contact angle of the wiper is maintained relative to the photosensitive drum.

Examples of prior art cleaning blades are shown in FIGS. 1 and 2 of the accompanying drawings. The cleaning blades (collectively 1A and 2A or 1B and 2B) are attached directly to a primary mounting 4, the geometry of which is dependant upon the particular machine design, to maintain a desired pressure, contact area, and geometric relationship, primarily parallelism, of the elastic wiper to the photosensitive drum being cleaned. FIG. 1 illustrates an example of a cleaning blade with an elastic wiper blade 2A molded onto a holder 1A, the blade having a flat surface abutting the surface of the photosensitive drum 3 to be cleaned and a sloped (or tapered) surface on the side opposite from the flat surface. FIG. 2 illustrates an example of a cleaning blade with an elastic wiper blade 2B of rectangular cross-section adhesively affixed to a holder 1B.

The cleaning blades shown in FIGS. 1 and 2 are mounted so the edge of the elastic wiper bears against the photosensitive drum in opposed relationship with the movement thereof (i.e. in the direction of the arrow) to remove toner and other residue. It should be noted that the cleaning blades of FIGS. 1 and 2 are not reversible and cannot be selectively mounted so that either opposite edges of the wiper blades clean the drum.

A disadvantage of the prior art is that the configurations of the various cleaning blades are very specific because they are designed only to mate with corresponding cleaning blade mounts without any regard for standardization or interchangeability. In other words, the prior art does not disclose or even suggest using a common cleaning blade configuration for different or multiple applications since the prior art does not teach or suggest any uniform means for locating and stabilizing the cleaning blade to preserve its geometric relationship to the photosensitive drum for differing cleaning blade mount configurations.

Moreover, the design and manufacture of prior art cleaning blades prevents their wiper blades from being reused in the event of a worn or defective wiper blade. The molded wiper blades cannot be removed without damaging them, thus preventing their replacement on a holder, and the adhesive on the adhesively attached wiper blades prohibits their removal and re-use on the rigid holder.

Furthermore, the configuration of the elastic wipers used in prior art are such that the thickness of the elastic wiper at the edge placed in contact with the photosensitive drum is less than or equal to the thickness of the elastic wiper at all points in the direction of the rigid holder. As the edge of the elastic wiper wears down, the contact pressure against the photosensitive drum diminishes, rendering the cleaning blade prematurely ineffective.

This invention overcomes the above-discussed problems and provides a universally usable cleaning blade which is preferably reversible for twice the useful life, and preferably has additional features which make it longer lasting. These advantages and attributes of this invention and others will be readily understood upon a reading of the text hereinafter.

SUMMARY OF THE INVENTION

It is an object of this invention to provide a cleaning blade system for electrophotography.

It is another object of this invention to provide a standardized and interchangeable cleaning blade configuration for the system.

It is another object of this invention to provide the system for use on new or existing electrophotography machines.

It is another object of this invention to provide an mounting adapter for the system which is capable of holding a cleaning blade in a plurality of positions enabling its use on a variety of electrophotographic machines.

It is another object of this invention to provide a reversible cleaning blade, whether symmetrical or non-symmetrical, so either edge of the wiper blade may be selectively used for cleaning the photosensitive drum used in electrophotographic apparatus, thus extending the useful life of the cleaning blade.

It is another object of this invention to provide a cleaning blade system cooperating with secondary mounting components, adapters, or shims to allow a particular cleaning blade configuration to be used in a variety of applications, including new or existing machines, thus providing a high degree of interchangeability.

It is another object of this invention to provide a cleaning blade system having mounting adapters with uniform means for holding a common or standardized cleaning blade, while also having multiple means for attaching such mounting adapters to different configurations of cleaning blade mount inherent in specific machine designs.

It is another object of this invention to provide a cleaning blade system using mounting adapters to provide a means to locate and stabilize the position of a specific cleaning blade configuration in a variety of applications, thus maintaining the desired pressure, contact area, and geometric relationship, especially parallelism, of the wiper blade to the photosensitive drum for different cleaning blade mount configurations.

It is another object of this invention to provide a cleaning blade system wherein the cleaning blade and the mounting adapter are configured in such a manner as to cooperate with one another to effectively register and adjust the position of the cleaning blade with respect to the photosensitive drum.

It is another object of this invention to provide a cleaning blade system wherein a plurality of longitudinal ridges on the rigid holder are used to position and maintain the cleaning blade in proper relationship with the photosensitive drum.

It is another object of this invention to provide a cleaning blade system wherein a plurality of longitudinal ridges on the rigid holder are used for engaging with similar ridges on an mounting adapter to position and maintain the cleaning blade in proper relationship with the photosensitive drum.

It is another object of this invention to provide a cleaning blade system with an interlock formed in the rigid holder so that the elastic wiper is secured in the holder without the use of adhesives.

It is another object of this invention to provide a cleaning blade system with a replaceable wiper blade.

It is another object of this invention to provide a cleaning blade system utilizing a wiper blade having flared edges where the thickness of the elastic wiper at the edge placed in contact with the photosensitive drum is greater than the thickness of the elastic wiper at one or more points in the direction of the rigid holder.

It is another object of this invention to provide a cleaning blade system with components having an extended useful life, reusability, and high degree of design standardization and interchangeability.

It is a further object of this invention to provide a cleaning blade system for electrophotography which can be installed on many of the existing machines types, greatly reducing the need for a separately configured system for each type of machine.

These objects, and other objects expressed or implied in this document, are accomplished by a universal cleaning blade system comprising: an elongated elastic wiper blade; an elongated rigid holder to which the wiper blade is affixed for longitudinal support; and a plurality of mounting adapters each for adapting the rigid holder to be mounted on at least one of the respective cleaning blade mounts. Preferably the wiper blade is reversible, and the rigid holder is reversibly mountable on the mounting adapters. Preferably the edge of the wiper blade that wipes a drum is flared in a direction normal to the drum for a longer useful blade life. Preferably each mounting adapter further comprises an interface for fastening said each mounting adapter to said at least one of the respective cleaning blade mounts in the same way that a conventional cleaning blade is fastened to said at least one of the respective cleaning blade mounts, and preferably there is a uniform interface between the rigid holder and the mounting adapters. Preferably the interface between the rigid holder and the mounting adapters further comprises opposing faces and complimentary locators defined by the opposing faces for precisely locating the rigid holder with respect to the mounting adapter, and preferably the locators comprise complementary striations defined by the opposing faces. Preferably the uniform wiper holder interfaces are declined toward the drums to compensate for the insertion of a mounting adapter between the holder and the cleaning blade mount, or alternatively the wiper blade projects from the holder at an angle with respect to a plane of the holder to compensate for the insertion of a mounting adapter between the rigid holder and the cleaning blade mount.

Other objects of this invention will be readily apparent from a reading of the text herein in conjunction with the accompanying drawings.

BRIEF DESCRIPTION OF THE DRAWINGS

FIG. 1 is a schematic representation of a cleaning blade having a molded wiper held in contact with a photosensitive drum according to the prior art.

FIG. 2 is a schematic representation of a cleaning blade having a glued on wiper held in contact with a photosensitive drum according to the prior art.

FIG. 3 is a schematic representation of a cleaning blade of the invention having a wiper blade held by a symmetrical rigid holder, the cleaning blade being fixed in contact with a photosensitive drum.

FIG. 4 is a schematic representation of a cleaning blade of the invention having a wiper blade held by a non-symmetrical rigid holder, the cleaning blade being fixed in contact with a photosensitive drum.

FIG. 5 is a representational lateral cross-section of an alternative embodiment of a cleaning blade including an interlocked mating between the wiper blade and the holder.

FIG. 6 is a partial lateral cross-section of a wiper blade of the type illustrated in FIG. 5, more clearly showing the flared edge opposite the interlocking edge.

FIG. 2, showing how a prior art blade and wiper holder mate with a cleaning blade mount.

DESCRIPTION OF THE PREFERRED EMBODIMENT

Figure 7:
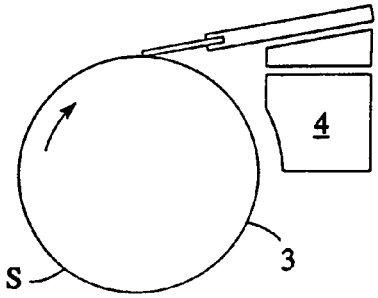
FIG. 7 is a schematical representation illustrating an alternative embodiment of a mounting adapter according to this invention without striations.

Referring to FIGS. 1 and 2, representations of the prior art electrophotographic cleaning blade systems are shown, each with a rigid holder 1A and 1B for holding an elastic wiper blade 2A and 2B in proper position and relationship against the rotating surface of a photosensitive drum 3. The rigid holders are secured to a cleaning blade mount 4 by fastening means, typically screws, to maintain the blade's position during operation. Wiper blade 2A is of the molded type and wiper blade 2B has a rectangular cross-section and is adhesively affixed to the rigid holder 1B. The rigid holders of the prior art are non-standardized and generally each holder will only fit into the particular electrophotographic machine for which is was designed.

Referring to FIG. 3, a conventional photosensitive drum 3 has a surface S which is selectively charged for the purpose of making reproductions, or copies, of an original image from which the surface was charged. The charged surface S attracts particles of toner or developer material (not shown) which are transferred to sheets of paper or other types of material as copies of the original image in the copying process. The surface S of the drum generally retains some particles of toner material (not shown) which did not become adhered to the paper or other material onto which the image was copied. These residual particles of toner must be cleaned from surface S prior to repeating the copying process in order to prevent such particles from affecting any new image to be copied. The drum surface S is cleaned of residual toner particles by a wiper blade 12, which is affixed to rigid. i.e. relatively stiff holder 14 which provides longitudinal support for the wiper blade 12 which is a relatively thin strip of elastic material, preferably polyurethane, having a generally rectangular cross-section. Preferably it is molded and then precisely trimmed to the desired dimensions, or cut from a preformed sheet. As illustrated, the two opposite short ends of the blade's rectangular cross-section are the long, or lateral, edges of the wiper blade. The wiper holder 14 is a strip or slat of relatively stiff or rigid material, which can preferably be made by an economic steel stamping process, but may as well be made of extruded aluminum or injection molded plastic. Preferably for reversibility the wiper holder 14 is symmetrical with respect to its median plane. A narrow channel 16 is defined along a drum-side edge of the rigid holder. The depth of the channel is sufficient to securely retain a long edge of the wiper blade 12 which can be held in the channel by friction. Adhesive (not shown) may also be used to affix the wiper blade in the channel 16. The rigid holder 14 preferably contains a plurality of parallel ridges 18, i.e. striations, running longitudinally on broad faces of the holder. As illustrated the striations are triangular in cross-section but not necessarily so. The striations could as well have other cross-sectional shapes including, but not limited to, a "sawtooth" pattern with one of the ridge's slopes vertical or at right angles to the rigid holder's lateral axis; slopes of differing angles; a "square wave" pattern; or even a "sinusoidal" pattern.

Referring again to FIG. 3, the combination of the wiper blade 12 and the rigid holder 14, when the wiper blade is affixed in the channel 16 of the rigid holder, with or without adhesive, is referred to as the "cleaning blade," generally designated 20. The cleaning blade preferably has a width at least that of the operational width of drum 3 in order clean the entire operational surface S of the drum. It is the cleaning blade, as a unit, which must be affixed in an electrophotographic apparatus in order that the free edge of the wiper blade is properly positioned for cleaning the surface S of the rotating photosensitive drum 3 of residual particles of toner. Each such apparatus has a cleaning blade mount 4 designed for properly affixing a respective or corresponding cleaning blade. As previously discussed, there has been no standardization of cleaning blades or method of attachment of a cleaning blade to a cleaning blade mount. However, by use of an mounting adapter 22, the cleaning blade 20 can be installed on new electrophotographic apparatus or can easily replace used cleaning blades on existing apparatus of differing makes and models.

Figure 9:
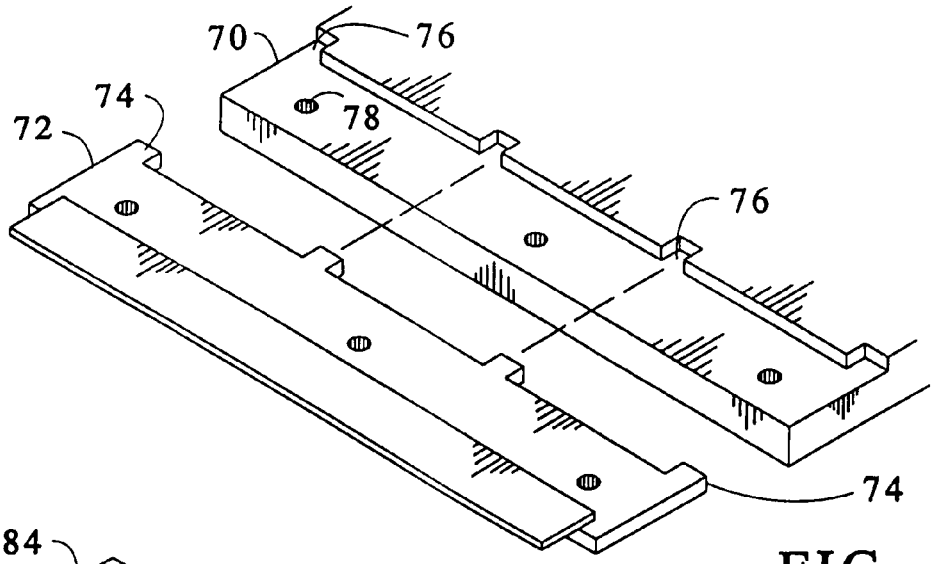
FIG. 9 PRIOR ART
FIG. 9 is an exploded pictorial view of the prior art, e.g.
Figure 10:
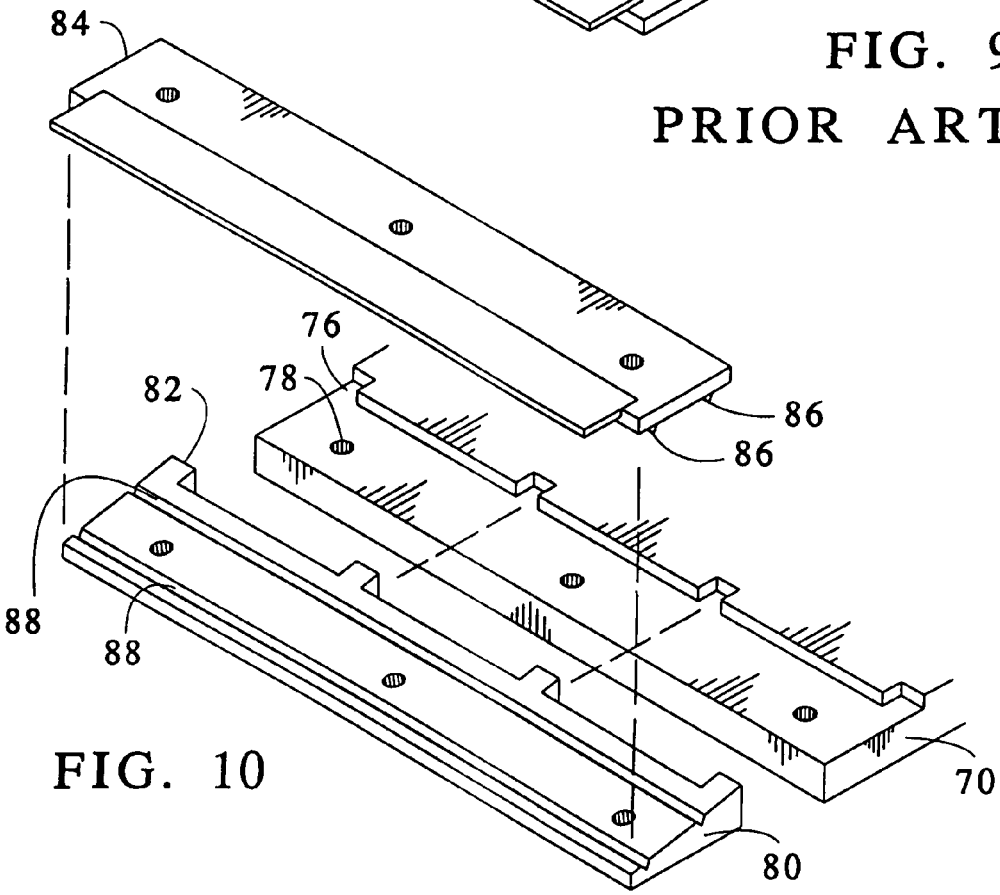
FIG. 10 is an exploded pictorial view of an exemplary assemblage according to this invention.

Referring again to FIG. 3, the mounting adapter 22 is a slat of rigid material, preferably the same as that of the rigid holder 14, and may be similarly manufactured, i.e. by a stamping process, by extrusion or by injection molding. The mounting adapter is preferably coextensive with the wiper holder. The mounting adapter has a conventional interface for attachment to the cleaning blade mount 4. This interface allows the mounting adapter to be affixed to the cleaning blade mount in the same way a conventional cleaning blade is attached thereto. Its opposite surface is an interface for having fastened thereto a wiper blade holder, and as illustrated this opposite surface preferably defines a plurality of striations, i.e. parallel ridges 24, which complementarily match (fit together) striations defined by the mating surface 18 of the wiper holder. Alternatively, the opposite surfaces of the wiper holder-mounting adapter interface can as well be flat, without complementary projections and depressions, e.g. grooves and ridges. As illustrated the wiper holder-mounting adapter interface is declined at a slight angle toward the drum to compensate for the interposition of the mounting adapter. Without the declination, the holder and wiper blade would be spaced too far away from the drum surface to clean it. The angle is determined by the available envelope in the apparatus and should be in accordance with the manufacturer's specifications to ensure proper performance of the cleaning blade. Conventionally the mounting adapter has a plurality of screw holes defined therein, and in addition ears or tabs may be defined by the mounting adapter for cooperation with notches in the cleaning blade mounts, as best illustrated in FIGS. 9 and 10.

Referring again to FIG. 3, the cleaning blade 20 mounts on a "topside" of the mounting adapter 22. The cleaning blade and the mounting adapter are attached as a unit to the cleaning blade mount 4 so that the desired pressure, contact area, and geometric relationship with respect to the photosensitive drum 3 are maintained. The illustrated striations help to accurately locate the cleaning blade in proper position, maintaining it essentially tangent with the surface S of the photosensitive drum 3. If as is preferable the wiper blade and wiper holder are symmetrical about their plane, they are reversible. This means that striations 18 of opposite sides of the wiper holder can register with the complementary striations 24 of the mounting adapter 22 when attached thereto, and either edge of the wiper blade in contact with the photosensitive drum 3 will maintain the desired pressure, contact area, and geometric relationship as when the cutting blade was reversed and the opposite edge of the blade was in contact with the drum.

Referring to FIG. 4, another embodiment of the invention is generally designated 30. The elastic wiper blade 32, as with the embodiment of FIG. 3, is preferably polyurethane and may be molded and trimmed to the required dimensions or, may be a polyurethane strip cut from a preformed sheet. The rigid holder 34 is similar to the rigid holder 14, except it has a flange 36 extending from one edge and running longitudinally the length of the rigid holder. One surface of the flange is an extension of the rigid holder's lateral surface and the other flange surface is recessed, providing a mounting surface for adhesively affixing the wiper blade 32 onto the flange. The thickness of the flange is such that when the wiper blade is affixed to the flange, the lateral axis of the wiper blade is essentially in line with the lateral axis of the rigid holder. The combination of the wiper blade 32 and the rigid holder 34, when the wiper blade is adhesively affixed to the flange 36 of the rigid holder, is referred to as the cleaning blade, generally designated 40. While not symmetrical, cleaning blade 40 is essentially the same as cleaning blade 20 in all other aspects, including being reversible about its lateral centerline, except primarily for the difference noted in the flange 36 of the rigid holder and the method of adhesively affixing the wiper blade 32 to the flange of the rigid holder. By use of an mounting adapter 22, the cleaning blade 40, similarly to cleaning blade 20, can be installed on new electrophotographic apparatus or can easily replace used cleaning blades on existing apparatus of differing makes and models.

Referring to FIGS. 5 and 6, a cleaning blade, generally designated 50, is a combination of an elastic wiper blade 52 and a rigid holder 54. The rigid holder is similar to the rigid holder 14 of FIG. 3, including striations 18, except it has a unique cross-section along the edge at which the wiper blade is attached. An interlocking, keyhole shaped channel 56 is defined within this edge. The channel extends the drum-side long edge of the rigid holder 54. The sides of the channel angle inward symmetrically from the lateral edge of the rigid holder and then join in a partially circular extension of the channel. The circular extension is wider than the interlocking ridges 58A and 58B formed by the angled sides and the partially circular extension of the channel. The wiper blade 52 is similar to the wiper blade 12, preferably being formed of molded polyurethane. However, its lateral cross-section is thicker, having slightly concave upper and lower surfaces which create flared contact edges 60A and 60B. The flared contact edges, being thicker than the wiper at one or more points in the direction of the rigid holder, provides enhanced contact with the photosensitive drum 3 and extended elastic wiper life. The wiper blade's opposite edge is formed to with a semi-circular head 62 attached to shoulders 64A and 64B which interlockingly conform to the keyhole channel 56. When the wiper blade 52 is installed by sliding it in the channel it is securely held in place without adhesives by the interlocking ridges 58A and 58B because the semi-circular head 62 of the wiper blade cannot be pulled laterally past the ridges 58A and 58B. Also, the shoulders 64A and 64B abut the inwardly angled channel sides to provide stability, keeping the wiper blade's lateral axis aligned with the lateral axis of the rigid holder 54. The cleaning blade 50 can be used similarly to the cleaning blades 20 and 40, with an mounting adapter 22 for replacing cleaning blades in existing electrophotographic apparatus.

Referring to FIG. 7, an alternative embodiment of the wiper holder-mounting adapter interface, and the cleaning blade mount-mounting adapter interface are illustrated.

In this embodiment there are not striations for registration, the striations having been replaced in function by other conventional means for fastening and registration of mating interfaces.

Figure 8:
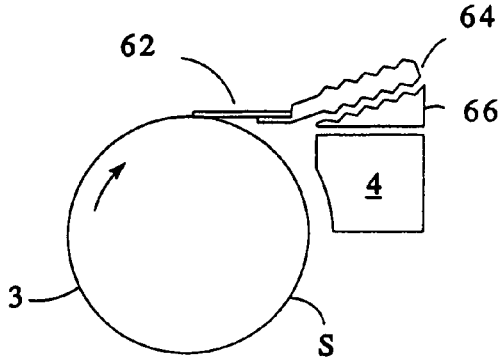
FIG. 8 is a schematical representation illustrating an alternative embodiment of a blade holder according to this invention.

Referring to FIG. 8, an alternative embodiment of the cleaning blade is illustrated. In this embodiment the wiper blade 62 projects from the rigid holder 64 at an angle with respect to a plane of the holder to compensate for the insertion of a mounting adapter 66 between the rigid holder and the cleaning blade mount 4.

Referring to FIGS. 9 and 10, FIG. 9 illustrates a typical prior art mating of a cleaning blade mount 70 with a cleaning blade 72, he blade being located on the mount by means of tabs 74 and mating slots 76, and fastened together by screw through holes 78. FIG. 10 illustrates a mounting adapter 80 which mounts on the cleaning blade mount 70 the same way that the blade 72 of FIG. 9 did, even to the point of mating tabs 82 with slots 76. Mounted on the mounting adapter is a standardized cleaning blade 84 which is located by a mating of lateral ridges 86 defined by an interface side of the blade 84 and grooves 88 defined by the interface side of the mounting adapter.

In the embodiments of the present invention depicted, the rigid holder and mounting adapter may be formed by aluminum extrusion. Extrusion methods provide complex shapes with accurate uniformity at low cost. An example of this versatility is the forming of the channels 16 and 56, wherein an elastic wiper blade may be cooperatively employed without adhesives. The elastic wiper blades 12 and 52 may be removed and the rigid holder re-used with a replacement elastic wiper blade. The extrusion method also provides longitudinal ridges formed on both sides of the rigid holder, which cooperate with similar ridges on the mating side of the mounting adapter. This ensures both stability and parallelism of the elastic wiper blade to the photosensitive drum axis when mounted.

Other manufacturing methods may be employed to form the rigid holder and mounting adapter to ensure stability and maintenance of the geometric relationship of the elastic wiper blade to the photosensitive drum. These include stamping methods, injection molding, or other suitable manufacturing techniques.

The rigid holder and elastic wiper, together forming the cleaning blade, may be standardized and, by variation in the configuration of the mounting adapter can be adapted to many different applications. If a stamping, injection molding, or other method is employed in the fabrication of the rigid holder or mounting adapter, longitudinal ridges can be formed in the parts to maintain their stability.

This invention embodies a standardized and interchangeable cleaning blade of either a molded or an adhesively affixed type consisting of an elastic wiper blade attached to a rigid holder made of stamped steel, extruded aluminum, or injection molded plastic. The standardized cleaning blade design will conform to accepted industry practices and may vary only by the inclusion of multiple mounting screw holes, multiple locating notches, or other mounting elements for improved adjustability in affixing them to cleaning blade mounts of differing configurations.

The standardized cleaning blade can also incorporate ridges in addition to screw holes and locating tabs or notches to facilitate their attachment to the mounting adapter. Steel stamping is the preferred method of manufacturing the rigid holder due to low cost and ease of manufacture and is the most common embodiment in current production. The cleaning blade cooperates with the mounting adapter when installed onto the cleaning blade mount 4, and together allow for the replacement of non-standardized cleaning blades of the prior art.

The mounting adapter has means for holding and attaching a cleaning blade to its ridged surface. In addition to multiple screw holes and ridges, other holding and attaching means may include ears or tabs, which cooperate with notches in the ends of the rigid holder. The mounting adapter will normally be slightly longer than the standard cleaning blade, varying according to the required compatibility for attaching the mounting adapter to a particular cleaning blade mount of differing configuration. The mounting adapter can be made of extruded aluminum or injection molded plastic, but the preferred construction is a stamping of steel sheet which facilitates the inclusion of multiple mounting and location registration elements such as screw holes, locating ears, tabs, notches, ridges, grooves, or flanges at low cost.

Any one of a plurality of mounting adapters or components can be made to fit two or more cleaning blade mounts where the slight differences in the configurations thereof are minimal. This similarity can occur in a group of machines from a particular manufacturer for example, and fitting of the new system to multiple cleaning blade mounts is easily accomplished by adding extra screw holes, notches, and other mounting elements to an mounting adapter. Adjusting the relative locations of the mounting elements in the cleaning blade and the mounting adapter will provide maintenance of the same pressure, contact area, and contact angle between the wiper blade and the drum as in the original prior art cleaning blade installation which is being replaced. The plurality of mounting adapters provides cleaning blade interchangeability.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims.

I claim:

1. For an electrophotographic machine having a drum and a cleaning blade mount for directly affixing thereon a drum cleaning blade having a machine-specific interface with the blade mount, an apparatus for replacing the machine-specific cleaning blade comprising:

(a) a wiper blade sized to clean the drum;

(b) a wiper holder to which the wiper blade is affixed for operational support;

(c) an adapter disposed between the wiper holder and the machine's blade mount for affixing the wiper holder to the blade mount;

(d) an interface defined by the adapter for mating with the machine's blade mount, said interface being compatible with said machine-specific interface; and (e) a mounting interface defined by the adapter and the wiper holder that disposes the wiper blade to clean the drum.

2. The apparatus according to claim 1 wherein the wiper blade declines toward the drum to compensate for the insertion of the adapter between the wiper holder and the blade mount.

3. The apparatus according to claim 1 wherein the wiper blade projects from the wiper holder at an angle with respect to a plane of the holder to compensate for the insertion of the adapter between the wiper holder and the blade mount.

4. The apparatus according to claim 1 wherein the mounting interface defined by the adapter and the wiper holder allows the wiper holder to be reversibly mounted on the adapter.

5. The apparatus according to claim 1 wherein an edge of the wiper blade that wipes the drum is flared in a direction normal to the drum for a longer useful blade life.

6. The apparatus according to claim 1 wherein the mounting interface defined by the adapter and the wiper holder further comprises opposing faces and complimentary locators defined by the opposing faces for precisely locating the wiper holder with respect to the adapter.

7. The apparatus according to claim 6 wherein the locators comprise complementary striations defined by the opposing faces.

8. The apparatus according to claim 6 wherein the locators comprise complementary grooves and ridges defined by the opposing faces.

9. The apparatus according to claim 6 wherein the locators comprise complementary pins and holes defined by the opposing faces.

10. The apparatus according to claim 6 wherein the locators comprise complementary tabs and slots defined by the opposing faces.

11. The apparatus according to claim 6 wherein the wiper blade declines toward the drum to compensate for the insertion of the adapter between the wiper holder and the blade mount.

12. The apparatus according to claim 6 wherein the wiper blade projects from the wiper holder at an angle with respect to a plane of the holder to compensate for the insertion of the adapter between the wiper holder and the blade mount.

13. The apparatus according to claim 1 further comprising an adjustable mounting interface defined by the adapter and the wiper holder interface for selective adjustment of the wiper blade's disposition relative to the drum.

14. The apparatus according to claim 2 further comprising an adjustable mounting interface defined by the adapter and the wiper holder interface for selective adjustment of the wiper blade's disposition relative to the drum.

15. The apparatus according to claim 3 further comprising an adjustable mounting interface defined by the adapter and the wiper holder for selective adjustment of the wiper blade's disposition relative to the drum.

16. For an electrophotographic machine having a drum and a cleaning blade mount for directly affixing thereon a drum cleaning blade designed to mate with the blade mount, an apparatus for replacing the drum cleaning blade with another drum cleaning blade not designed to mate with the blade mount, the apparatus comprising:

(a) an adapter disposed between said another drum cleaning blade and the machine's blade mount for affixing said another drum cleaning blade to the blade mount;

(b) an interface defined by the adapter for mating with the machine's blade mount; and (c) a mounting interface defined by the adapter and said another drum cleaning blade that disposes said another drum cleaning blade to clean the drum.

17. The apparatus according to claim 16 wherein said another drum cleaning blade declines toward the drum to compensate for the insertion of the adapter between said another drum cleaning blade and the blade mount.

18. The apparatus according to claim 16 wherein said another drum cleaning blade comprises a wiper blade and a wiper blade holder, the wiper blade projecting from the wiper holder at an angle with respect to a plane of the holder to compensate for the insertion of the adapter between said another drum cleaning blade and the blade mount.

19. The apparatus according to claim 16 wherein the mounting interface defined by the adapter and said another drum cleaning blade allows the latter to be reversibly mounted on the adapter.

20. The apparatus according to claim 16 further comprising an adjustable mounting interface defined by the adapter and said another drum cleaning blade for selective adjustment of the latter's disposition relative to the drum.

* * * * *